US007010824B2

(12) United States Patent
Stubler et al.

(10) Patent No.: US 7,010,824 B2
(45) Date of Patent: Mar. 14, 2006

(54) METHOD FOR ANCHORING PARALLEL WIRE CABLES AND SUSPENSION SYSTEM FOR A CONSTRUCTION WORK

(75) Inventors: Jérôme Stubler, Paris (FR); Mike McClenahan, Montigny le Bretonneux (FR); Ivica Zivanovic, Arnouville les Gonesses (FR)

(73) Assignee: Freyssinet International (STUP), Velizy Cedex (FR)

( * ) Notice: Subject to any disclaimer, the term of this patent is extended or adjusted under 35 U.S.C. 154(b) by 0 days.

(21) Appl. No.: 10/466,918

(22) PCT Filed: Jun. 2, 2003

(86) PCT No.: PCT/EP03/06464

§ 371 (c)(1),
(2), (4) Date: Jul. 26, 2004

(87) PCT Pub. No.: WO2004/106635

PCT Pub. Date: Dec. 9, 2004

(65) Prior Publication Data

US 2004/0237222 A1 Dec. 2, 2004

(51) Int. Cl.
*E01D 19/16* (2006.01)
*E01D 11/00* (2006.01)

(52) U.S. Cl. ..... 14/22; 14/21; 14/77.1; 52/223.13

(58) Field of Classification Search ..... 14/18–23, 14/78, 77.1; 52/223.13, 223.14
See application file for complete search history.

(56) References Cited

U.S. PATENT DOCUMENTS

| | | | | |
|---|---|---|---|---|
| 3,864,776 | A | 2/1975 | Hedefina et al. | |
| 4,427,718 | A | 1/1984 | Heron et al. | |
| 4,557,007 | A * | 12/1985 | Daiguji et al. | 14/22 |
| 4,633,540 | A | 1/1987 | Jungwirth et al. | |
| 4,718,965 | A * | 1/1988 | Finsterwalder et al. | 156/294 |
| 5,173,982 | A * | 12/1992 | Lovett et al. | 14/22 |
| 5,390,386 | A | 2/1995 | Mathey et al. | |
| 6,055,691 | A | 5/2000 | Nützel et al. | |
| 6,322,281 | B1 | 11/2001 | Jungwirth et al. | |
| 6,523,207 | B1 * | 2/2003 | Stubler et al. | 14/22 |
| 6,560,807 | B1 * | 5/2003 | Stubler et al. | 14/22 |
| 6,578,329 | B1 * | 6/2003 | Stubler et al. | 52/223.14 |
| 6,658,684 | B1 * | 12/2003 | Stubler et al. | 14/22 |
| 6,715,176 | B1 * | 4/2004 | Stubler et al. | 14/22 |
| 2002/0028112 | A1 * | 3/2002 | Paulshus et al. | 405/224.2 |
| 2002/0108329 | A1 * | 8/2002 | Bournand et al. | 522/223.13 |
| 2003/0086755 | A1 * | 5/2003 | Stubler et al. | 403/204 |
| 2003/0110583 | A1 * | 6/2003 | Stubler et al. | 14/22 |
| 2004/0111987 | A1 * | 6/2004 | Paulshus et al. | 52/223.13 |

FOREIGN PATENT DOCUMENTS

| | | |
|---|---|---|
| DE | 147 104 C | 1/1904 |
| DE | 35 38 014 | 6/1987 |
| DE | 196 21 832 | 12/1997 |

(Continued)

*Primary Examiner*—Thomas B. Will
*Assistant Examiner*—Alexandra Pechhold
(74) *Attorney, Agent, or Firm*—Banner & Witcoff, Ltd.

(57) ABSTRACT

The structural cable (2) to be anchored, such as a main suspension cable or a stay cable, is made of a compact bundle of parallel metallic wires. The cable wires are distributed into seven-wire units (18) in a portion of the cable adjacent to an anchor block (13), and these seven-wire units are individually anchored on the anchor block.

48 Claims, 4 Drawing Sheets

FOREIGN PATENT DOCUMENTS

| | | | |
|---|---|---|---|
| DE | 202 05 149 | | 7/2002 |
| EP | 1 065 317 | | 1/2001 |
| FR | 62 434 E | | 6/1955 |
| FR | 2 346 517 | | 10/1977 |
| GB | 2 092 210 | | 8/1982 |
| JP | 2003147902 A | * | 5/2003 |
| WO | WO 98/39532 | | 9/1998 |

* cited by examiner 1
2
3
4
5
6
7
8
10
11
12
31
35
P
III

METHOD FOR ANCHORING PARALLEL WIRE CABLES AND SUSPENSION SYSTEM FOR A CONSTRUCTION WORK

BACKGROUND OF THE INVENTION

The present invention relates to the use of structural cables in construction works such as bridges. In particular, the invention is applicable to suspension bridges and cable-stayed bridges.

In a suspension bridge, the deck is supported via hangers attached to one or more main suspension cables. Each suspension cable is anchored at both ends and deviated on one or more pylons erected along the bridge span. In a cable-stayed bridge, the deck is supported by a set of cables, called stays, each extending between a pylon and an anchorage mounted on the deck.

In most suspension bridges, the main suspension cables usually consist of a bundle of parallel metallic wires arranged side by side in a compact configuration. It has also been proposed to build the main suspension cables from seven-wire strands, each strand having six peripheral wires twisted around a central wire (see e.g. EP-A-0 950 762). Such strand is advantageously surrounded by a plastic sheathing which may further contain an anti-corrosion product such as grease or wax. That sort of strand is more frequently used in pre-stressing applications or to form stays in a cable-stayed construction (see e.g. EP-A-0 323 285).

The traction forces to which the cable is subjected are taken up by its metallic wires. For a given load capacity of the cable, the use of seven-wire strands leads to a cable having an overall cross-section significantly larger than a cable consisting of a compact bundle of parallel wires. Geometrically, the twisting of the wires in a strand requires more space than the compact stacking of parallel wires. In addition, the individual sheathing of the strands also occupies a certain space.

When the cable must include a large number of metallic wires, such as in large suspension bridges where a main cable typically has several thousands of wires, parallel wires are generally preferred to avoid having a too large cross-section of the cable. It is also an established technology.

In a cable-stayed arrangement, the load is distributed between a larger number of stays each having a smaller number of wires (typically between 100 and 1,000 wires), which makes it more practical to use prefabricated strands. However, it is sometimes required to minimize the diameter of the stays, in particular for aerodynamic reasons. Therefore, parallel wire cables are sometimes used in cable-stayed works as well.

However, a shortcoming of parallel wire cables is the bulk of their anchorage systems. Usually, the main cables on major suspension bridges are fabricated in situ from many steel wires laid out on a catwalk along the cable line and anchored by looping around a series of semi-circular cables shoes attached to an anchor block. Each shoe typically receives more than a hundred wires. At the anchorage, the cable shoes are distributed over a large surface and are themselves anchored in a massive structure. In addition, the fan distribution of the cable wires at the anchorage requires a massive deviation saddle with a support structure to resist large transversal forces from the deviation of the cable under tension. Most of the time, the anchorage region is placed on a large foundation built in the ground.

Some suspension bridges are of the "self-anchored" type, which means that the main suspension cables are, at one or both of their ends, anchored by means of an anchoring system mounted on the bridge deck.

In such a case, the forces exerted by the suspension cable are taken up by the compression of the deck and/or by piers built underneath and connected to the deck by tie-down members. In such an application, the bulk of the anchorage systems for the suspension cables is very problematic, so that it may be impossible to install them on the deck.

To alleviate these difficulties, it may be considered to replace a pair of suspension cables by only one cable forming a loop below the deck in the region where it connects with the deck. However, such a loop arrangement generates other problems. In particular, it is extremely difficult, if feasible, to put in place thousands of individual wires parallel to each other along a path of several hundreds of meters extending alternately above and below the deck. In addition, assuming that the latter difficulty is overcome, very large friction forces are induced in the curvature region where the cable loops under and around the deck to sustain it. Such friction occurs as the load is applied on the suspension cable, i.e. as the hangers are attached and tensioned. It may result in damage to the cable and/or to the deck. Trying to avoid such damage requires an additional tensioning system on the lower face of the deck to equalize the traction forces undergone by the cable below and above the deck, which further complicates the structure and its construction.

In view of these problems, an object of the present invention is to provide a method making it possible to provide a relatively compact anchorage for a cable consisting of multiple wires in a parallel bundle arrangement.

SUMMARY OF THE INVENTION

According to the invention, a method of anchoring an end of a cable, comprising a compact bundle of parallel metallic wires, comprises the steps of distributing at least part of the cable wires into seven-wire units in a portion of the cable adjacent to an anchor block, and individually anchoring the seven-wire units on the anchor block.

In other words, in the anchorage region, groups of seven-wire are formed to be individually anchored, thus making it possible to use the technology which has proved efficient for anchoring stay cables or pre-stressing cables. The seven-wire units are not stranded like in the latter applications, so that some features, as discussed later on, may be helpful to provide a firmer anchorage of the units.

The anchor block is typically located behind the supporting structure and aligned on the cable axis, so that the cable requires no axial deviation and the fan expansion of the seven-wire units as they approach the anchorage can be kept small. The resulting anchorage is thus very compact.

Because the seven-wire units are anchored individually and identically, the performance of the whole cable anchorage is similar to that of an individual unit anchorage. It is therefore possible to use this type of anchorage for very large parallel wire cables, such as those used in large suspension bridges.

The method is also applicable to cable-stayed structures. In such a case, the anchorage can be similar to those conventionally used with seven-wire strands (except that the seven-wire units are not stranded), and the method results in a significant reduction of the cross-section of the stays.

Another aspect of the present invention relates to a suspension system for a construction work comprising at least one cable for supporting a suspended part of the work and means for anchoring at least one end of the cable relative to a support structure. The anchoring means comprise an anchor block bearing against the support structure. The cable comprises a compact bundle of parallel metallic wires. At least part of the cable wires are distributed into seven-wire units in a portion of the cable adjacent to the anchor block. These seven-wire units are individually anchored on the anchor block.

A further aspect of the invention relates to a suspension bridge comprising a suspension system as set out hereabove, a deck forming the suspended part, and at least one pylon. The suspension system includes at least one suspension cable deviated on the pylon and anchored by the anchoring means of the suspension system, and hangers each attached to the deck and to a suspension cable.

Yet a further aspect of the invention relates to a cable-stayed bridge comprising a suspension system as set out hereabove, a deck forming the suspended part, and at least one pylon. The suspension system includes a plurality of stay cables each extending between the pylon and the deck and anchored by the anchoring means of the suspension system.

BRIEF DESCRIPTION THE DRAWINGS

DESCRIPTION OF PREFERRED EMBODIMENTS

Figures 1, 2, 3:
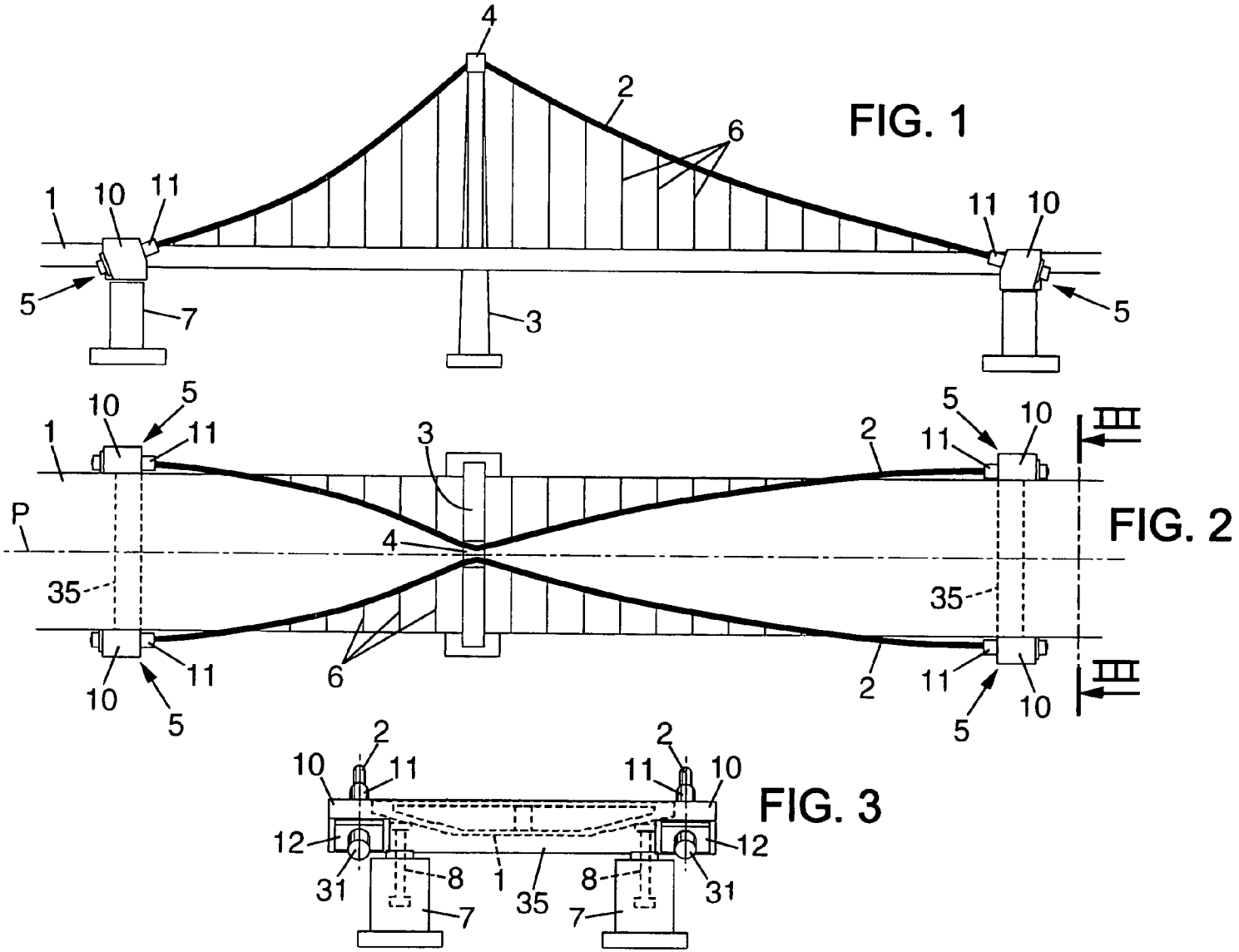
FIGS. 1 and 2 are elevation and top views, respectively, of a suspension bridge according to the invention.
FIG. 3 is a cross-sectional view of that bridge, along plane III—III shown in FIG. 2.

The bridge shown in FIGS. 1–3 has a section constructed as a suspension bridge of the self-anchored type with a single pylon 3.

In that section, the deck 1 is supported by means of main suspension cables 2 arranged symmetrically on both sides of a vertical plane P located in the middle of the deck (FIG. 2). Each suspension cable 2 is deviated on a saddle 4 mounted on top of the pylon 3. Its both ends are anchored on the deck 1 by means of respective anchoring systems 5. Between the pylon 3 and each anchorage 5, a set of hangers 6 are attached to the main suspension cable 2 at their upper end, and to the deck 1 at their lower end. The hangers 6 transmit the load of the deck 1 to the main cables 2.

Piers 7 are erected under the deck 1 in the region of the anchorage systems 5 of the main cables. As shown diagrammatically in FIG. 3, tie-down cables or bars 8 are fixed to each pier 7 and to the deck 1. These tie-down members 8 are designed to take up the vertical component of the force exerted by the main cables 2 on the deck.

The deck 1 is for example made of concrete, with a conventional girder configuration as illustrated by dashed lines in FIG. 3. In the anchorage region, the deck has two lateral extensions 10 made of concrete or steel, each forming a support structure for the anchoring system 5 of a main cable end. A steel tube 11 extends through the concrete extension 10 to receive the main cable 2 in the anchorage region. The guide tube 11 is positioned when molding the concrete of the support structure 10.

On the rear side of the anchorage (FIGS. 3–4), the guide tube 11 is connected to a bearing plate 12, against which an anchor block 13 is applied. The block 13 and the plate 12 transmit the load of the cable to the support structure 10.

Figure 4:
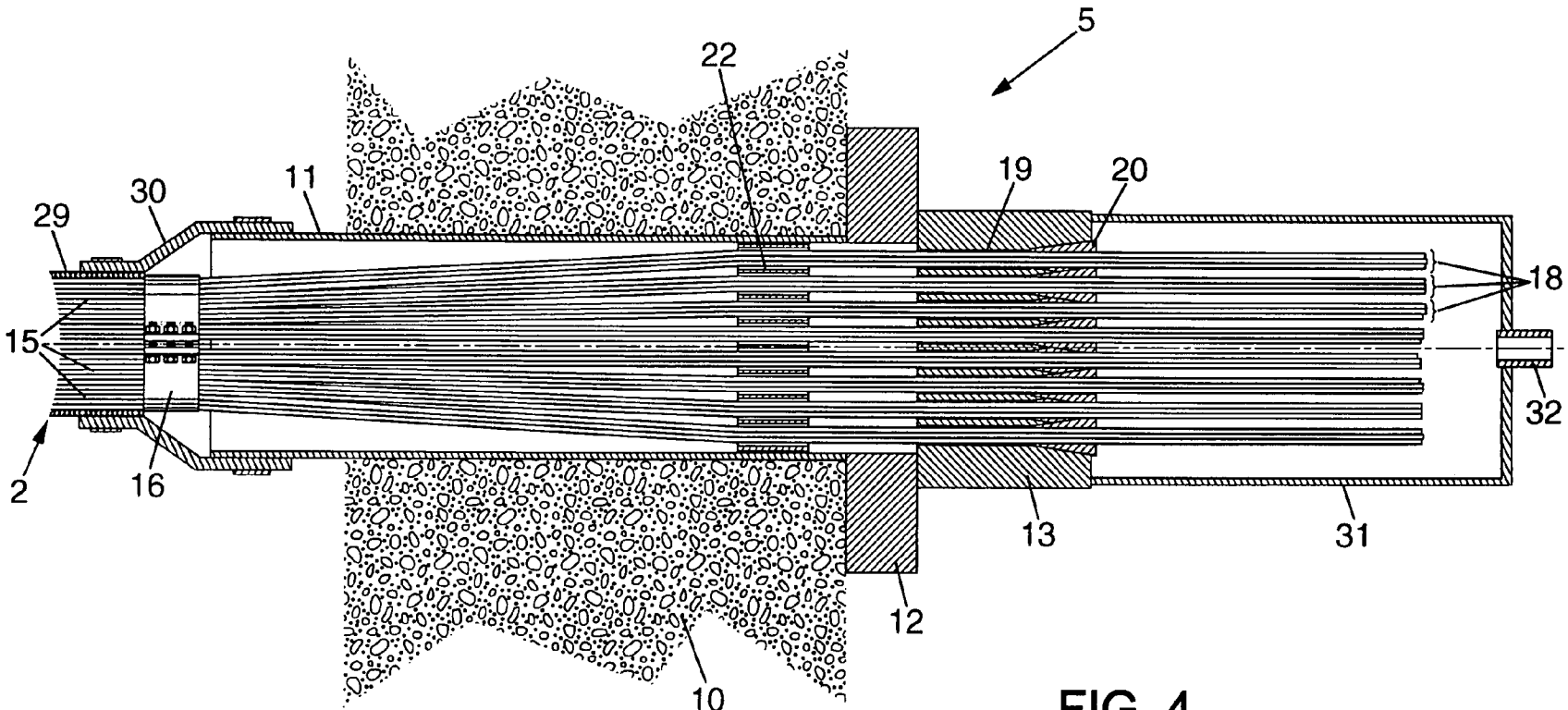
FIG. 4 is a longitudinal sectional view of an anchoring region of a cable anchored in accordance with an embodiment of the invention.

The main cable 2 consists of a compact bundle of parallel metallic wires 15, as shown in the left part of FIG. 4. Near the entrance of the guide tube 11, a compacting collar 16 is tightened to keep the wires together in the running part of the cable.

In order to make it possible to anchor the wires 15, the anchor block 13 must have a larger cross-section than the compact bundle forming the running part of the cable 2. According to the invention, at the exit of the compacting collar 16, the wires 15 are grouped by units of seven wires, and each of these units is passed through a respective orifice provided in the block 13 to be anchored. These orifices 19 extend parallel to each other within the block 13. They have a generally cylindrical shape with a diameter slightly larger than the diameter of the seven-wire unit 18. On the rear side of the block, these orifices taper outwardly to have a conical shape matching the external shape of a conical jaw 20.

In order to guide the seven-wire units 18 parallel to each other as they approach the rear part of the anchor block 13 which receives the jaws 20, a deviator 22 may be housed within the guide tube 11. That deviator consists for instance of a steel plate provided with bores having the same pattern as the orifices 19 of the anchor block 13. Each of these bores receives a seven-wire unit to align it with the direction of its anchoring orifice 19, thus avoiding undesired bending moments in the anchor block 13. The bores of the deviator 22 may have a rounded shape at their end facing the running part of the cable, in order to smoothly guide the seven-wire units 18.

In another embodiment, the anchor block 13 is made thicker so that the deviator is embodied as the front part of the block, with a suitable shape in front of the guide tube so as to guide the wires.

The fan-out of the wires between the compacting collar 16 and the deviator 22 can be kept relatively low. Advantageously, the portion of the cable where the wires extends parallel to each other between the deviator 22 and the anchor block 13 has a transverse dimension less than three times larger than the compact bundle forming the running part of the cable 2. Typically the ratio of these transverse dimensions will be of the order of 2.

In a large suspension bridge, the main cable 2 may have between 15,000 and 20,000 individual wires and an overall diameter of between 0.5 and 1 m. In such a large bridge, the diameter of the anchor block 13 can be smaller than 2 meters. This is much more compact that what can be achieved with a conventional type of anchorage, which would have a transverse dimension at least two to three times larger and which could not be designed in alignment with the direction of the cable 2. In that kind of work, the support structure 10 typically has a thickness of about 20 meters, so that the guide tube 11 can easily accommodate the angular deflection of the seven-wire units 18 between the compacting collar 16 and the deviator 22.

Figure 5:
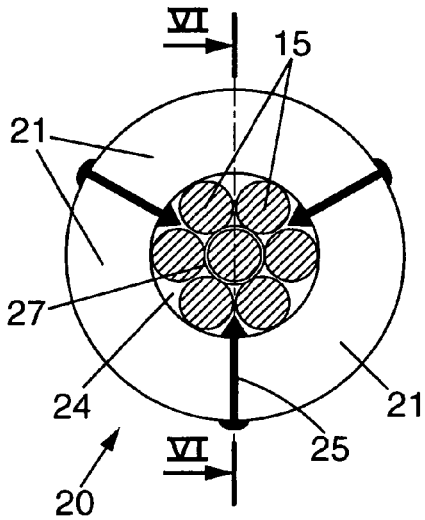
FIG. 5 is an end view illustrating the individual anchorage of a seven-wire unit.
Figure 6:
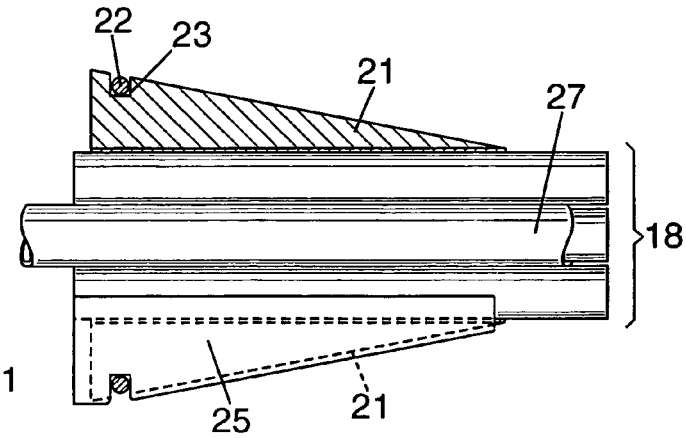
FIG. 6 is a longitudinal sectional view of the anchored unit, along plane VI—VI shown in FIG. 5.

FIGS. 5 and 6 show the configuration of the conical jaw 20 which grips a seven-wire unit 18 within the anchor block 13. In the illustrated embodiment, the jaw consists of three wedge segments 21 each representing a 120° sector of the generally conical shape. The three segments are held together by a metallic ring 22 inserted in a peripheral groove 23 provided near the wider end of the jaw. The jaw has a central cylindrical bore 24 to receive the seven wires of the unit 18. As is well known, the inner surface of the wedges 21 may have transverse corrugations to firmly grip the metallic wires in the axial bore 24.

The jaw 20 is quite similar to those used to anchor strands of pre-stressing cables or stays. However, the wires 15 do not have the helical pitch of such strands, since they run parallel to each other. To secure a good anchorage of the seven-wire unit 18, the jaw 20 is so positioned that each wire located in the periphery of the seven-wire unit is in contact with only one of the wedge segments 21. Such positioning may be achieved by means of positioning members 25 inserted in the intervals separating two adjacent wedge segments 21. In the illustration of FIG. 5, three positioning members 25 are respectively inserted in the intervals between the three wedge segments 21. These positioning members 25 are in the form of small plates which protrude into the axial bore 24 to be received in a trough defined between two adjacent peripheral wires 15. The protruding part has a pointed shape to be comfortably received in a trough, so that the interval between two adjacent wedge segments will never be in contact with one of the wires, thus achieving the desired property that each wire is in contact with only one of the wedge segments. The positioning members 25 are made of a compressible material, such as a soft plastic, which is extruded out of the anchoring orifice 19 to allow the wedge segments 21 to tighten.

It will be appreciated that many types of positioning means can be used to achieve that property. For example, it would be enough to provide only one plate-shaped positioning member 25. It is also possible to dispense with such members within the orifice of the anchor block, for example by pulling each unit 18 with a jack fitted with lugs at the entry orifice to guide the orientation of the wire group through the jack wedges, the latter being aligned with the wedge segments 21 of the anchoring jaw.

In addition, various other types of individual anchoring means can be used to anchor the seven-wire units 18 (jaws with 2, 3, 4, . . . wedge segments, button heads, etc.).

When a group of seven-wires is clamped in a cylindrical bore, it may happen that the six peripheral wires of the group bear against each other without transferring the clamping action to the central wire (arching effect). To improve the performance of the anchorage, it may be judicious to provide a larger cross-section of the central wire within the anchoring jaw 20.

In the embodiment of FIGS. 5 and 6, this is achieved by arranging a sleeve 27 around the central wire in the portion of the unit 18 gripped by the jaw 20 and also beyond that portion (so that the wires can be tensioned by means of a jack having similar gripping jaws). The sleeve 27 may be metallic, with a wall thickness of about 10% of the wire diameter. The sleeve 27 prevents arching of the peripheral wires, by virtue of its compression during wedging by transversal gripping forces imposed on the outer wires, thus gripping the central wires by friction.

Alternatively, it is possible to use two types of wires 15 to construct the main cable 2: a first type of wire has a diameter of, say, 5.0 mm and a second type of wire, in a proportion six times smaller, having a diameter of, say, 5.1 mm. When forming a seven-wire unit 18 for the anchorage, the central wire is selected from the wires of the second type, and the six peripheral wires are of the first type.

Another advantage of the proposed anchoring method is that it makes it easy to provide an efficient dehumidification system to protect the metallic wires from corrosion. To do so, the volume containing the wires 15 of the cable is sealed, and dry air is admitted and circulated within that volume in order to prevent contact between the steel wires and rain or condensation water and to eliminate any humidity within the cable.

The sealing of the running part of the cable is conventionally performed by wrapping an elastomer strip 29 (e.g. made of "neoprene") helically around the compact bundle of wires to form an air-tight envelope. Before the neoprene wrapping, a metallic wire may be wound around the cable, with contiguous coils, to mechanically protect the wires 15 when objects hit the cable. At the transition with the guide tube 11 near the anchorage, a sealing boot 30 made of an elastomer material such as neoprene, is fitted around the cable and sealingly connected to the neoprene wrapping 29 and to the exterior of the guide tube 11. At the rear of the anchor block 13, an air-tight cover 31 is placed and fixed to the block 13 or to the bearing plate 12. The cover 31 is provided with an air inlet opening 32 to admit dry air within the volume of the cable occupied by the metallic wires 15.

It will be appreciated that such a dry air dehumidification system is very difficult to use in the case of a conventional anchorage which requires a large fan-out of the wires and a deviation saddle.

As shown in FIGS. 2 and 3, the supporting structures 10 of the anchorage systems 5 for the corresponding ends of the two main suspension cables 2 are located symmetrically at opposite ends of a transverse beam 35 belonging to the deck 1. The tie-down members 8 are fixed to that beam 35 and to the piers 7.

Pre-stressing cables are placed within the transverse beam 35. These pre-stressing cables extend longitudinally in the beam 35, i.e. transversely in the deck 1. They compensate for the bending moments undergone by the beam 35 due to the leverage resulting from the distance between the attachment points of the main cable 2 and of the tie-down members 8 on both sides of the deck. Notwithstanding, it will be noted that the relatively compact layout of the proposed anchorage makes it possible to position the attachment of the tie-down members 8 practically under the anchorage, which minimizes those moments, hence reducing the need for pre-stressing.

Figure 7:
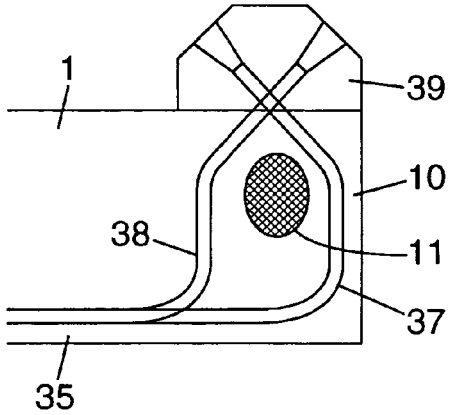
FIG. 7 is a diagrammatic cross-sectional view of an anchoring region of the deck in a bridge according to FIGS. 1–3.

Advantageously, the pre-stressing cables provided in the transverse beam 35 may have an arrangement such as shown in FIG. 7, suitable for reinforcing the mounting of the anchoring systems 5. These pre-stressing cables press the anchorage supporting structures 10 against the beam 35 to secure their connection to the deck 1. They also reinforce the concrete region through which the guide tube 11 extends. In the example of FIG. 7, some pre-stressing cables follow paths 37 which surround the guide tube 11 cast in the supporting structure 10 before extending in the longitudinal direction of the beam 35. Other pre-stressing cables follow paths 38 which circumvent the guide tube 11. The pre-stressing cables may be tensioned and anchored on a pad 39 located at the upper surface of the deck 1. Other pre-stressing arrangements are of course usable.

Figure 8:
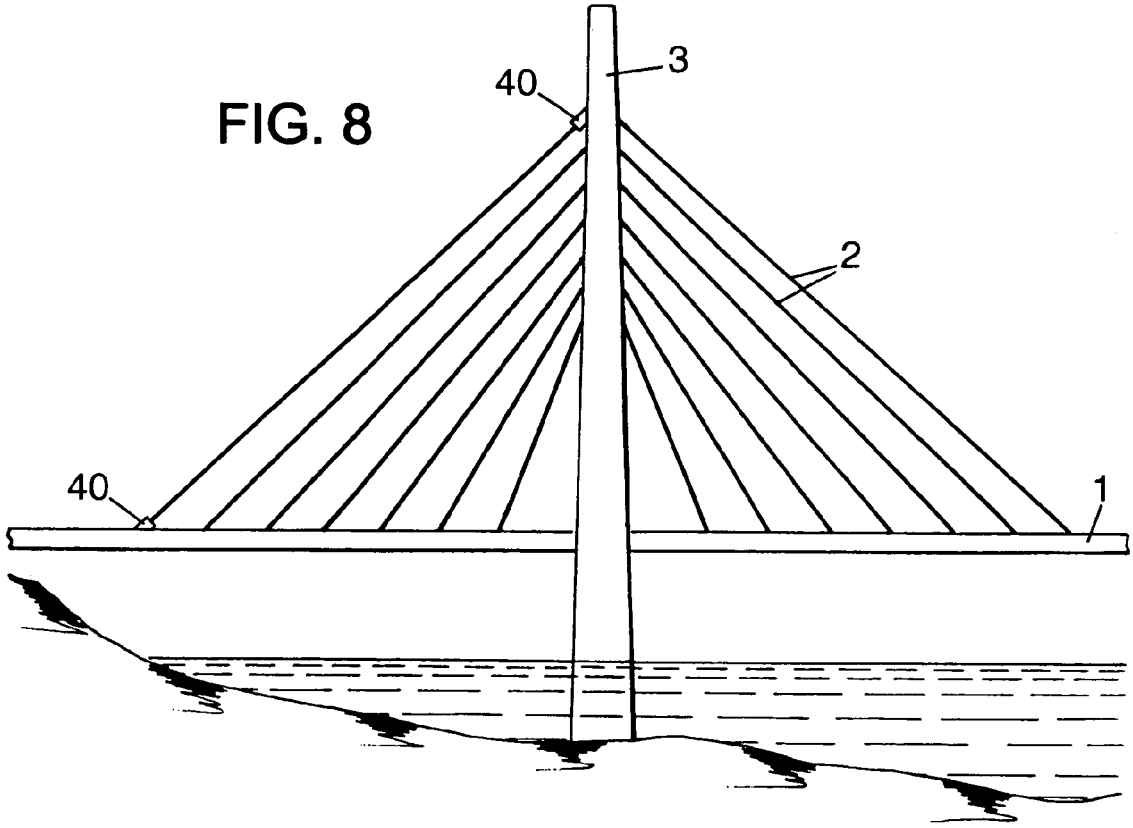
FIG. 8 is a schematic elevation view of a cable-stayed bridge which may be built according to the invention.

The previously described anchoring method can be applied to various types of construction work. In particular, it is also applicable to cable-stayed bridges as illustrated in FIG. 8.

In a cable-stayed bridge, the deck 1 is supported by stay cables 2 distributed on both sides of a pylon 3. Each stay cable 2 is significantly smaller in diameter than the main suspension cables referred to previously. A large stay typically include a few hundreds of metallic wires.

Once the number of wires of a stay cable is set, the parallel wire compact configuration ensures the minimum cross-section of the stay, hence its minimum sensitivity to the wind. The anchorages 40 of the stay (for simplicity, only one pair of anchorages is shown on FIG. 8) are advantageously executed as described previously (though with smaller dimensions than in the case of a main suspension cable).

Accordingly, the numerous anchorages 40 distributed along the deck of the cable-stayed bridge can be kept relatively compact, thus simplifying the structure of the deck and the aesthetics of the bridge.

The above-described features of the invention are also applicable to conventional suspension bridges which are not of the self-anchored type, the main suspension cable(s) being attached to massifs in the ground.

What is claimed is:

1. A method of anchoring an end of a cable comprising a compact bundle of parallel metallic wires, the method comprising the steps of distributing at least part of the cable wires into seven-wire units in a portion of the cable adjacent to an anchor block, and individually anchoring the seven-wire units on the anchor block, by conical wedge action, wherein a seven-wire unit is anchored by means of a jaw of generally conical shape having a central cylindrical bore and comprising an assembly of wedge segments each representing an angular sector of the conical shape, the jaw being introduced into a complementary orifice of the anchor block with the seven-wire unit extending through the cylindrical bore thereof, and wherein the jaw is so positioned that each wire located in the periphery of the seven-wire unit is in contact with only one of the wedge segments.

2. The method as claimed in claim 1, wherein the wires of the bundle are of substantially identical diameter, the method further comprising the step of arranging a sleeve around a central wire of a seven-wire unit in a portion of the unit gripped by a conical jaw in the anchor block.

3. The method as claimed in claim 1, wherein the bundle of wires includes wires of a first type of substantially even diameter and wires of a second type having a larger diameter than the wires of the first type, the method further comprising the step of forming each seven-wire unit by arranging six wires of the first type around a wire of the second type.

4. The method as claimed in claim 1, wherein the jaw is positioned by arranging at least one positioning member in a interval separating two of the wedge segments the positioning member having a portion protruding within the cylindrical bore to be accommodated in a trough formed between two wires in the periphery of the seven-wire unit.

5. The method as claimed in claim 1, wherein said portion of the cable adjacent to the anchor block comprises a first section where the seven-wire units spread from the compact bundle arrangement to deviator means and a second section where the seven-wire units extend parallel to each other from the deviator means to a part of the anchor block where the seven-wire units are anchored.

6. The method as claimed in claim 5, wherein the deviator means comprises a front part of the anchor block.

7. The method as claimed in claim 5, wherein the second section of said cable portion has a transverse dimension less than three times larger than said compact bundle.

8. The method as claimed in claim 1, wherein said portion of the cable adjacent to the anchor block extends through a tube mounted on a support structure and connected to a bearing plate against which the anchor block is applied.

9. The method as claimed in claim 1, further comprising the steps of sealing a volume containing the metallic wires of the cable, and providing air circulation means to admit dry air within said volume for protection against corrosion of the wires.

10. The method as claimed in claim 9, wherein said portion of the cable adjacent to the anchor block extends through a tube mounted on a support structure and connected to a bearing plate against which the anchor block is applied, and wherein the step of sealing said volume comprises wrapping the bundle of wires with an air-tight envelope, fitting a sealing boot between the wrapped envelope and said tube, and placing an air-tight cover over the anchor block.

11. A suspension system for a construction work, comprising at least one cable for supporting a suspended part of the work and means for anchoring at least one end of the cable relative to a support structure, wherein the anchoring means comprise an anchor block bearing against the support structure, wherein the cable comprises a compact bundle of parallel metallic wires, wherein at least part of the cable wires are distributed into seven-wire units in a portion of the cable adjacent to the anchor block, and wherein the seven-wire units are individually anchored on the anchor block by conical wedge action, wherein the anchoring means comprise jaws of generally conical shape for respectively anchoring the seven-wire units, each jaw having a central cylindrical bore and comprising an assembly of wedge segments each representing an angular sector of the conical shape, the jaw being introduced into a complementary orifice of the anchor block with the seven-wire unit extending through the cylindrical bore thereof, and wherein the jaw is so positioned that each wire located in the periphery of the seven-wire unit is in contact with only one of the wedge segments.

12. The suspension system as claimed in claim 11, wherein the wires of the bundle are of substantially identical diameter, and wherein a sleeve is placed around a central wire of a seven-wire unit in a portion of the unit gripped by a conical jaw in the anchor block.

13. The suspension system as claimed in claim 11, wherein the bundle of wires includes wires of a first type of substantially even diameter and wires of a second type having a larger diameter than the wires of the first type, and wherein each seven-wire unit comprises six wires of the first type arranged around a wire of the second type.

14. The suspension system as claimed in claim 11, wherein the jaw is positioned by means of at least one positioning member arranged in a interval separating two of the wedge segments, the positioning member having a portion protruding within the cylindrical bore to be accommodated in a trough formed between two wires in the periphery of the seven-wire unit.

15. The suspension system as claimed in claim 11, wherein said portion of the cable adjacent to the anchor block comprises a first section where the seven-wire units spread from the compact bundle arrangement to deviator means and a second section where the seven-wire units extend parallel to each other from the deviator means to the anchor block.

16. The suspension system as claimed in claim 15, wherein the second section of said cable portion has a transverse dimension less than three times larger than said compact bundle.

17. The suspension system as claimed in claim 11, wherein said portion of the cable adjacent to the anchor block extends through a tube mounted on the support structure and connected to a bearing plate against which the anchor block is applied.

18. The suspension system as claimed in claim 11, further comprising means for sealing a volume containing the metallic wires of the cable, and air circulation means to admit dry air within said volume for protection against corrosion of the wires.

19. The suspension system as claimed in claim 18, wherein said portion of the cable adjacent to the anchor block extends through a tube mounted on the support structure and connected to a bearing plate against which the anchor block is applied, and wherein the sealing means comprise an air-tight envelope wrapped around the bundle of wires, a sealing boot fitted between the wrapped envelope and said tube, and an air-tight cover placed over the anchor block.

20. The suspension system as claimed in claim 19, wherein the air circulation means comprise air inlet means arranged on said cover.

21. A suspension bridge, comprising a suspension system, a deck, and at least one pylon, wherein the suspension system includes at least one suspension cable deviated on the pylon, hangers each attached to the deck and to a suspension cable and means for anchoring at least one end of the suspension cable relative to a support structure, wherein the anchoring means comprise an anchor block bearing against the support structure, wherein the suspension cable comprises a compact bundle of parallel metallic wires, wherein at least part of the cable wires are distributed into seven-wire units in a portion of the suspension cable adjacent to the anchor block, and wherein the seven-wire units are individually anchored on the anchor block by conical wedge action, wherein the anchoring means comprise jaws of generally conical shape for respectively anchoring the seven-wire units, each jaw having a central cylindrical bore and comprising an assembly of wedge segments each representing an angular sector of the conical shape, the jaw being introduced into a complementary orifice of the anchor block with the seven-wire unit extending through the cylindrical bore thereof, and wherein the jaw is so positioned that each wire located in the periphery of the seven-wire unit is in contact with only one of the wedge segments.

22. A suspension bridge as claimed in claim 21, wherein the anchoring means are mounted on the deck.

23. A suspension bridge as claimed in claim 22, wherein the anchoring means comprise two anchoring systems mounted symmetrically on two sides of the deck for anchoring respective ends of two suspension cables, and pre-stressing means to exert a transversal pre-stressing effort on the deck in a region extending between the two anchoring systems.

24. A suspension bridge as claimed in claim 23, wherein the pre-stressing means comprise pre-stressing cables having respective paths defined in the deck, at least some of said pre-stressing cables having portions extending through said support structure to reinforce the mounting of the anchoring systems.

25. A cable-stayed bridge, comprising a suspension system, a deck, and at least one pylon, wherein the suspension system includes a plurality of stay cables each extending between the pylon and the deck and means for anchoring at least one end of each one of the plurality of stay cables relative to a support structure, wherein the anchoring means comprise an anchor block bearing against the support structure, wherein said one of the plurality of stay cables comprises a compact bundle of parallel metallic wires, wherein at least part of the cable wires are distributed into seven-wire units in a portion of the stay cable adjacent to the anchor block, and wherein the seven-wire units are individually anchored on the anchor block by conical wedge action, wherein the anchoring means comprise jaws of generally conical shape for respectively anchoring the seven-wire units, each jaw having a central cylindrical bore and comprising an assembly of wedge segments each representing an angular sector of the conical shape, the jaw being introduced into a complementary orifice of the anchor block with the seven-wire unit extending through the cylindrical bore thereof, and wherein the jaw is so positioned that each wire located in the periphery of the seven-wire unit is in contact with only one of the wedge segments.

26. The cable-stayed bridge as claimed in claim 26, wherein the suspension system further comprises means for sealing a volume containing the metallic wires of said one of the plurality of stay cables, and air circulation means to admit dry air within said volume for protection against corrosion of the wires.

27. The suspension bridge as claimed in claim 21, wherein the suspension system further comprises means for sealing a volume containing the metallic wires of the suspension cable, and air circulation means to admit dry air within said volume for protection against corrosion of the wires.

28. A method of anchoring an end of a cable comprising a compact bundle of parallel metallic wires, the method comprising the steps of distributing at least part of the cable wires into seven-wire units in a portion of the cable adjacent to an anchor block, individually anchoring the seven-wire units on the anchor block, sealing a volume containing the metallic wires of the cable, and providing air circulation means to admit dry air within said volume for protection against corrosion of the wires, wherein said portion of the cable adjacent to the anchor block extends through a tube mounted on a support structure and connected to a bearing plate against which the anchor block is applied, and wherein the step of sealing said volume comprises wrapping the bundle of wires with an air-tight envelope, fitting a sealing boot between the wrapped envelope and said tube, and placing an air-tight cover over the anchor block.

29. The method as claimed in claim 28, wherein the seven-wire units are anchored by conical wedge action.

30. The method as claimed in claim 29, wherein the wires of the bundle are of substantially identical diameter, the method further comprising the step of arranging a sleeve around a central wire of a seven-wire unit in a portion of the unit gripped by a conical jaw in the anchor block.

31. The method as claimed in claim 29, wherein the bundle of wires includes wires of a first type of substantially even diameter and wires of a second type having a larger diameter than the wires of the first type, the method further comprising the step of forming each seven-wire unit by arranging six wires of the first type around a wire of the second type.

32. The method as claimed in claim 28, wherein said portion of the cable adjacent to the anchor block comprises a first section where the seven-wire units spread from the compact bundle arrangement to deviator means and a second section where the seven-wire units extend parallel to each other from the deviator means to a part of the anchor block where the seven-wire units are anchored.

33. The method as claimed in claim 32, wherein the deviator means comprises a front part of the anchor block.

34. The method as claimed in claim 32, wherein the second section of said cable portion has a transverse dimension less than three times larger than said compact bundle.

35. The method as claimed in claim 28, wherein said portion of the cable adjacent to the anchor block extends through a tube mounted on a support structure and connected to a bearing plate against which the anchor block is applied.

36. A suspension system for a construction work, comprising at least one cable having a compact bundle of parallel metallic wires for supporting a suspended part of the work, means for anchoring at least one end of the cable relative to a support structure, means for sealing a volume containing the metallic wires of the cable, and air circulation means to admit dry air within said volume for protection against corrosion of the wires, wherein the anchoring means comprise an anchor block bearing against the support structure, wherein at least part of the cable wires are distributed into seven-wire units in a portion of the cable adjacent to the anchor block, wherein the seven-wire units are individually anchored on the anchor block, wherein said portion of the cable adjacent to the anchor block extends through a tube mounted on the support structure and connected to a bearing plate against which the anchor block is applied, and wherein the sealing means comprise an air-tight envelope wrapped around the bundle of wires, a sealing boot fitted between the wrapped envelope and said tube, and an air-tight cover placed over the anchor block.

37. The suspension system as claimed in claim 36, wherein the seven-wire units are anchored by conical wedge action.

38. The suspension system as claimed in claim 37, wherein the wires of the bundle are of substantially identical diameter, and wherein a sleeve is placed around a central wire of a seven-wire unit in a portion of the unit gripped by a conical jaw in the anchor block.

39. The suspension system as claimed in claim 37, wherein the bundle of wires includes wires of a first type of substantially even diameter and wires of a second type having a larger diameter than the wires of the first type, and wherein each seven-wire unit comprises six wires of the first type arranged around a wire of the second type.

40. The suspension system as claimed in claim 36, wherein said portion of the cable adjacent to the anchor block comprises a first section where the seven-wire units spread from the compact bundle arrangement to deviator means and a second section where the seven-wire units extend parallel to each other from the deviator means to the anchor block.

41. The suspension system as claimed in claim 40, wherein the second section of said cable portion has a transverse dimension less than three times larger than said compact bundle.

42. The suspension system as claimed in claim 36, wherein said portion of the cable adjacent to the anchor block extends through a tube mounted on the support structure and connected to a bearing plate against which the anchor block is applied.

43. The suspension system as claimed in claim 36, wherein the air circulation means comprise air inlet means arranged on said cover.

44. A suspension bridge, comprising a suspension system, a deck, and at least one pylon, wherein the suspension system includes at least one suspension cable having a compact bundle of parallel metallic wires and deviated on the pylon, hangers each attached to the deck and to a suspension cable, means for anchoring at least one end of the suspension cable relative to a support structure, means for sealing a volume containing the metallic wires of the cable, and air circulation means to admit dry air within said volume for protection against corrosion of the wires, wherein the anchoring means comprise an anchor block bearing against the support structure, wherein at least part of the cable wires are distributed into seven-wire units in a portion of the suspension cable adjacent to the anchor block, wherein the seven-wire units are individually anchored on the anchor block, wherein said portion of the cable adjacent to the anchor block extends through a tube mounted on the support structure and connected to a bearing plate against which the anchor block is applied, and wherein the sealing means comprise an air-tight envelope wrapped around the bundle of wires, a sealing boot fitted between the wrapped envelope and said tube, and an air-tight cover placed over the anchor block.

45. A suspension bridge as claimed in claim 44, wherein the anchoring means are mounted on the deck.

46. A suspension bridge as claimed in claim 45, wherein the anchoring means comprise two anchoring systems mounted symmetrically on two sides of the deck for anchoring respective ends of two suspension cables, and pre-stressing means to exert a transversal pre-stressing effort on the deck in a region extending between the two anchoring systems.

47. A suspension bridge as claimed in claim 46, wherein the pre-stressing means comprise pre-stressing cables having respective paths defined in the deck, at least some of said pre-stressing cables having portions extending through said support structure to reinforce the mounting of the anchoring systems.

48. A cable-stayed bridge, comprising a suspension system, a deck, and at least one pylon, wherein the suspension system includes a plurality of stay cables each extending between the pylon and the deck and each having a compact bundle of parallel metallic wires, means for anchoring at least one end of each one of the plurality of stay cables relative to a support structure, means for sealing a volume containing the metallic wires of the cable, and air circulation means to admit dry air within said volume for protection against corrosion of the wires, wherein the anchoring means comprise an anchor block bearing against the support structure, wherein at least part of the cable wires are distributed into seven-wire units in a portion of the stay cable adjacent to the anchor block, and wherein the seven-wire units are individually anchored on the anchor block, wherein said portion of the cable adjacent to the anchor block extends through a tube mounted on the support structure and connected to a bearing plate against which the anchor block is applied, and wherein the sealing means comprise an air-tight envelope wrapped around the bundle of wires, a sealing boot fitted between the wrapped envelope and said tube, and an air-tight cover placed over the anchor block.

* * * * *